US005762328A

United States Patent [19]

Yamada et al.

[11] Patent Number: 5,762,328

[45] Date of Patent: Jun. 9, 1998

[54] SUBSEQUENT PAPER TREATMENT APPARATUS

[75] Inventors: Kenji Yamada; Yukitaka Nakazato, both of Tokyo, Japan

[73] Assignee: Ricoh Company, Ltd., Tokyo, Japan

[21] Appl. No.: 660,278

[22] Filed: Jun. 7, 1996

[30] Foreign Application Priority Data

Jun. 7, 1995 [JP] Japan ..... 7-140778
Apr. 9, 1996 [JP] Japan ..... 8-086772

[51] Int. Cl.[6] ..... B65H 39/02

[52] U.S. Cl. ..... 270/58.08; 270/58.11

[58] Field of Search ..... 270/58.08, 58.09, 270/58.11, 58.13, 58.12

[56] References Cited

U.S. PATENT DOCUMENTS

| | | | |
|---|---|---|---|
| 5,037,077 | 8/1991 | Kubota et al. | 270/58.12 |
| 5,056,774 | 10/1991 | Kubota et al. | 271/213 |
| 5,072,920 | 12/1991 | Kubota et al. | 270/53 |
| 5,083,760 | 1/1992 | Yamazaki et al. | 270/53 |
| 5,114,130 | 5/1992 | Hamanaka et al. | 270/58.11 |
| 5,121,911 | 6/1992 | Yamazaki et al. | 270/53 |
| 5,263,697 | 11/1993 | Yamazaki et al. | 270/53 |
| 5,320,336 | 6/1994 | Asami | 370/58 |
| 5,462,265 | 10/1995 | Mandel et al. | 270/58.09 |
| 5,508,798 | 4/1996 | Yamada | 355/324 |
| 5,580,038 | 12/1996 | Furuya et al. | 270/58.11 |

*Primary Examiner*—John T. Kwon
*Attorney, Agent, or Firm*—Oblon, Spivak, McClelland, Maier & Neustadt, P.C.

[57] ABSTRACT

A subsequent paper treatment apparatus stably conveys a bound recording paper bundle toward a paper discharging tray. A discharging claw 10*a* of the discharging belt is pressed to the rear edge of the bound recording paper bundle. when a discharging belt is moved and thereby the recording paper bundle is also moved toward a paper discharging tray, if the recording paper bundle not heavy, the jogger fence presses the side surface of the recording paper bundle in order to apply a conveying resistance thereto, and thereby bounding of the recording paper bundle can be prevented.

7 Claims, 12 Drawing Sheets

SUBSEQUENT PAPER TREATMENT APPARATUS

BACKGROUND OF THE INVENTION

1. Field of the Invention

The present invention relates to a subsequent paper treatment apparatus installed at the downstream side of an image forming apparatus such as copying machine, printer, facsimile device, etc.

2. Description of the Related Art

Conventionally, there has been proposed a subsequent paper treatment apparatus comprising a jogger fence for laterally aligning the recording paper having an image formed thereon, a rear edge fence for aligning or setting a standard position of the recording paper in the longitudinal direction, a stapling apparatus for binding the aligned recording paper bundle and a paper discharging belt for moving the bound recording paper bundle to a paper discharging tray.

In the above-mentioned conventional subsequent paper treatment apparatus, when the claw of the rotating endless discharging belt is brought into contact with the rear edge of the bound recording paper bundle to discharge the bundle toward the paper discharging tray, the claw collides with the rear edge of the stationary recording paper bundle, which may bounce or bound and thereby disengage from the claw. Such a problem can be avoided by causing the claw to collide with the rear edge of the paper bundle at an extremely low speed. However, such a speed-down lowers productivity.

SUMMARY OF THE INVENTION

It is a first object of the present invention to solve the aforementioned problems of the related art.

It is a second object of the present invention to temporarily increase the conveying resistance of the belt so that the bounding of the recording paper bundle can be prevented at the time of collision between the claw and the paper bundle, and the recording paper can be conveyed stably.

It is a third object of the present invention to provide a subsequent recording paper treatment apparatus capable of improving productivity by preventing bounding without requiring an extreme slow-down of the claw's speed at the time of colliding with the recording paper bundle.

It is a fourth object of the present invention to provide a subsequent recording paper treatment apparatus in which the bounding of lightweight recording paper bundles can be prevented without applying an excessive conveying resistance to the belt when conveying recording paper of large size having inherently large conveying resistance.

It is a fifth object of the present invention to provide a subsequent recording paper treatment apparatus in which the conveying resistance can be temporarily applied to the belt only at the moment of collision between the claw and the rear edge of the recording paper bundle and immediately thereafter.

It is a sixth object of the present invention to provide a subsequent recording paper treatment apparatus in which conveying resistance can be temporarily applied during the time period from the moment of the impingement between the claw and the rear end of the recording paper bundle to another moment of discharging the recording paper bundle by use of the discharging roller, and when the recording paper bundle is discharged by the discharging roller the aforementioned conveying resistance can be eliminated, and thereby a stable paper conveying can be realized.

The above and other objects are attained by a subsequent recording paper treatment apparatus comprising a jogger fence for aligning the copied recording paper discharged from the main body of an image forming apparatus in a direction lateral to the direction of movement, a rear-edge fence for determining a standard paper position in the direction of movement, a stapling apparatus binding the aligned recording paper bundle, and a discharging belt provided with a claw for moving the bound recording paper bundle toward the paper discharging tray. The jogger fence is moved to a paper bundle pressing position and presses the same as it is moved via the discharging belt.

According to a further feature of the invention, the aforementioned jogger fence is moved to the paper bundle pressing position when the paper size is not larger than a predetermined value.

According to a further feature of the invention, the aforementioned jogger fence is moved onto the paper bundle pressing position when the number of the bound paper sheets is not larger than a predetermined value.

According to yet a further feature of the invention, the pressing of the recording paper bundle by the jogger fence is released after moving the recording paper bundle by a predetermined distance.

According to yet a further feature of the invention, the restraint of the recording paper bundle by the jogger fence is released at a position before the discharging roller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
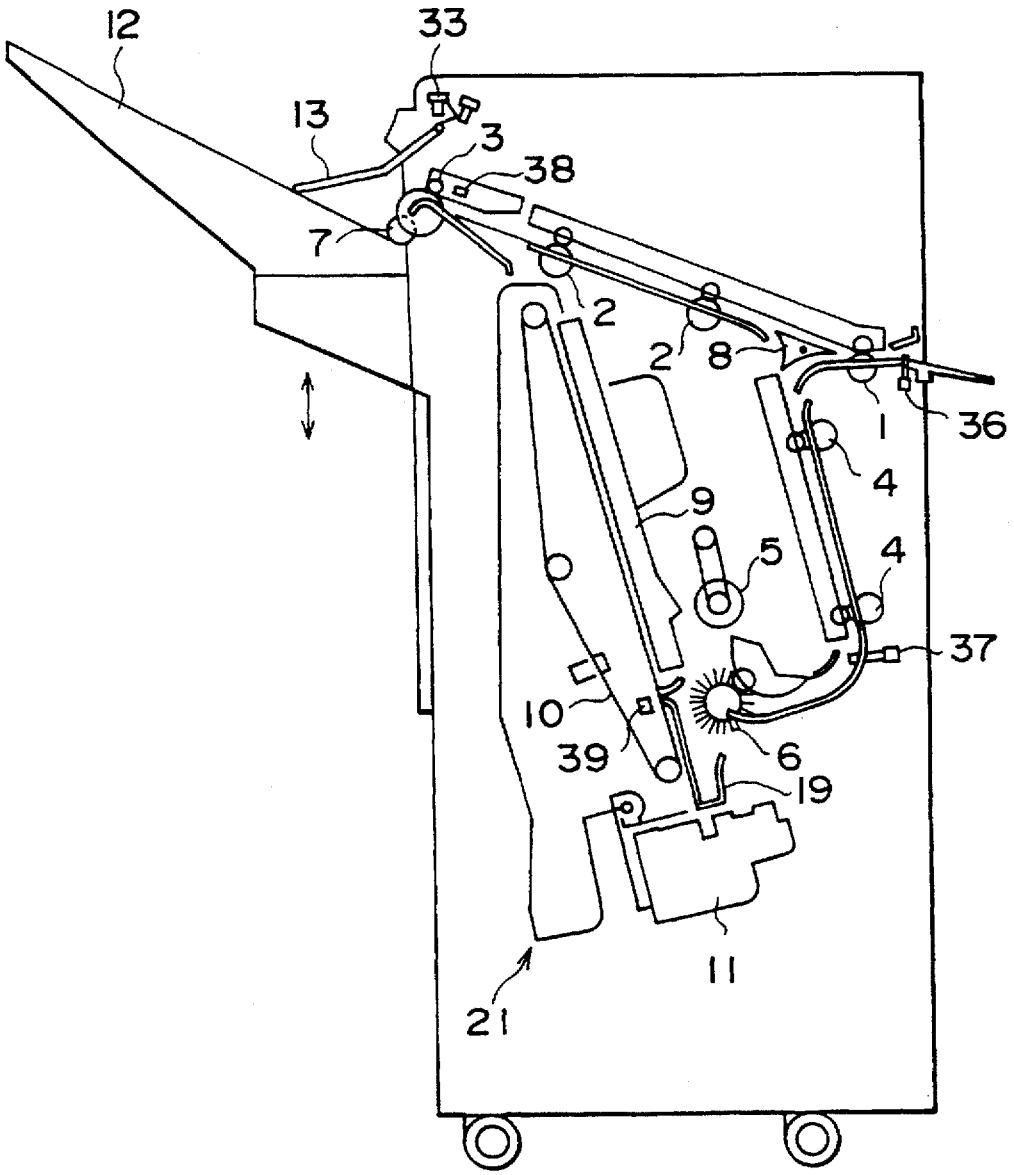
FIG. 1 is a schematic view showing an overall construction of a subsequent recording paper treatment processing apparatus of the embodiment according to the present invention.

An embodiment of the present invention are described hereinafter, referring to the drawings attached hereto.

In FIG. 1, an inlet sensor 36, an inlet roller 1, and a separating claw 8 are provided at the inlet of the recording paper discharge conveying path for discharging the paper from the copying machine. The separating claw 8 is actuated by a branching (separating) solenoid 53 (shown only in FIG. 6). The recording paper to be forwarded toward a discharging tray 12 and the recording paper to be forwarded toward a stapling apparatus 11 are separated by the separating claw 8.

In the conveying path toward the paper discharging tray 12 are arranged plural upper conveying rollers 2, a discharged paper sensor 38, a discharging rollers 3, a putting-aside roller 7 for pushing the recording paper to one side, a paper surface lever 13 which moves up and down in accordance with the height of the piled recording papers and a paper surface sensor 33 responsive to the lever 13. On the other hand, in the conveying path toward the stapling apparatus 11 are arranged plural lower conveying rollers 4, a discharged paper sensor 37 and a paper feeding roller (platen roller) 6.

The lowermost conveying roller 4 is driven by a conveying motor 54, and the paper discharging tray 12 is respectively moved up-and-down and right-and-left by an up-and-down motor 51 and a shift motor 52.

The stapling apparatus 11 is disposed at the lower end of the staple tray 21. At the stapling tray 21 are respectively arranged a jogger fence 9 for aligning the recording paper, a returning roller 5, and a discharging belt 10 for discharging the bound recording paper bundle. The discharging belt 10 has a home sensor 39.

Figure 2:
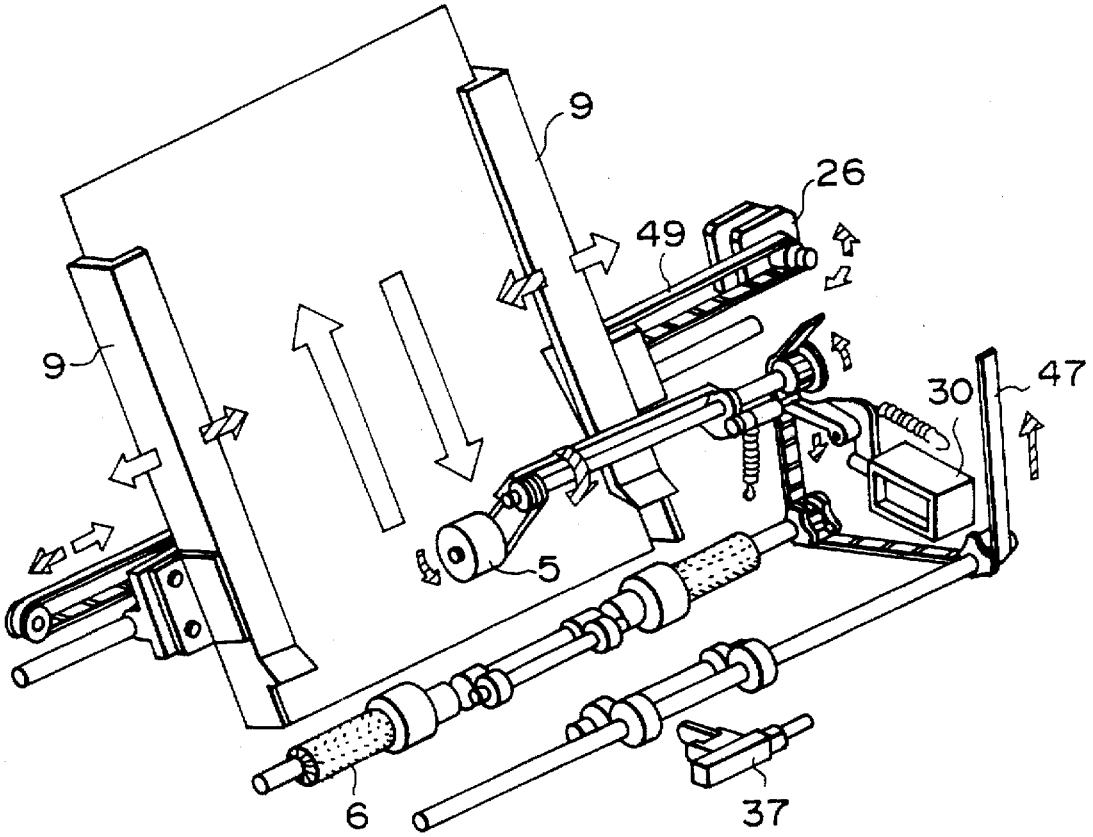
FIG. 2 is a perspective view showing a driving mechanism for driving a jogger fence and a returning roller.

As shown in FIG. 2, the jogger fence 9 is composed of two L section fence elements. The fence elements are driven in opposite directions by the jogger motor 26, via the jogger belt 49. For example, the two fence elements may be respectively connected to upper and lower runs of the jogger belt 49.

The returning solenoid 30 reciprocates the shaft mounting the returning roller 5, thereby causing the reciprocating roller 5 to engage or disengage from the surface of the recording paper. The returning and brush rollers 6 and 30 are rotated, in a direction shown by the arrow in FIG. 3, by the brush roller belt 47.

Figure 3:
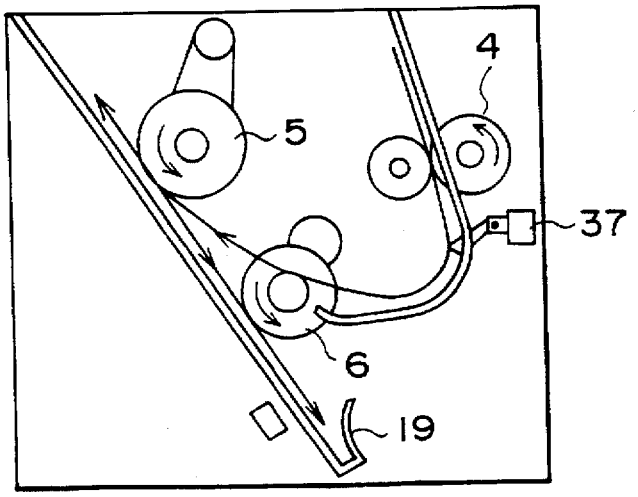
FIG. 3 is an enlarged view showing an area near the rear edge fence portion.
Figure 4:
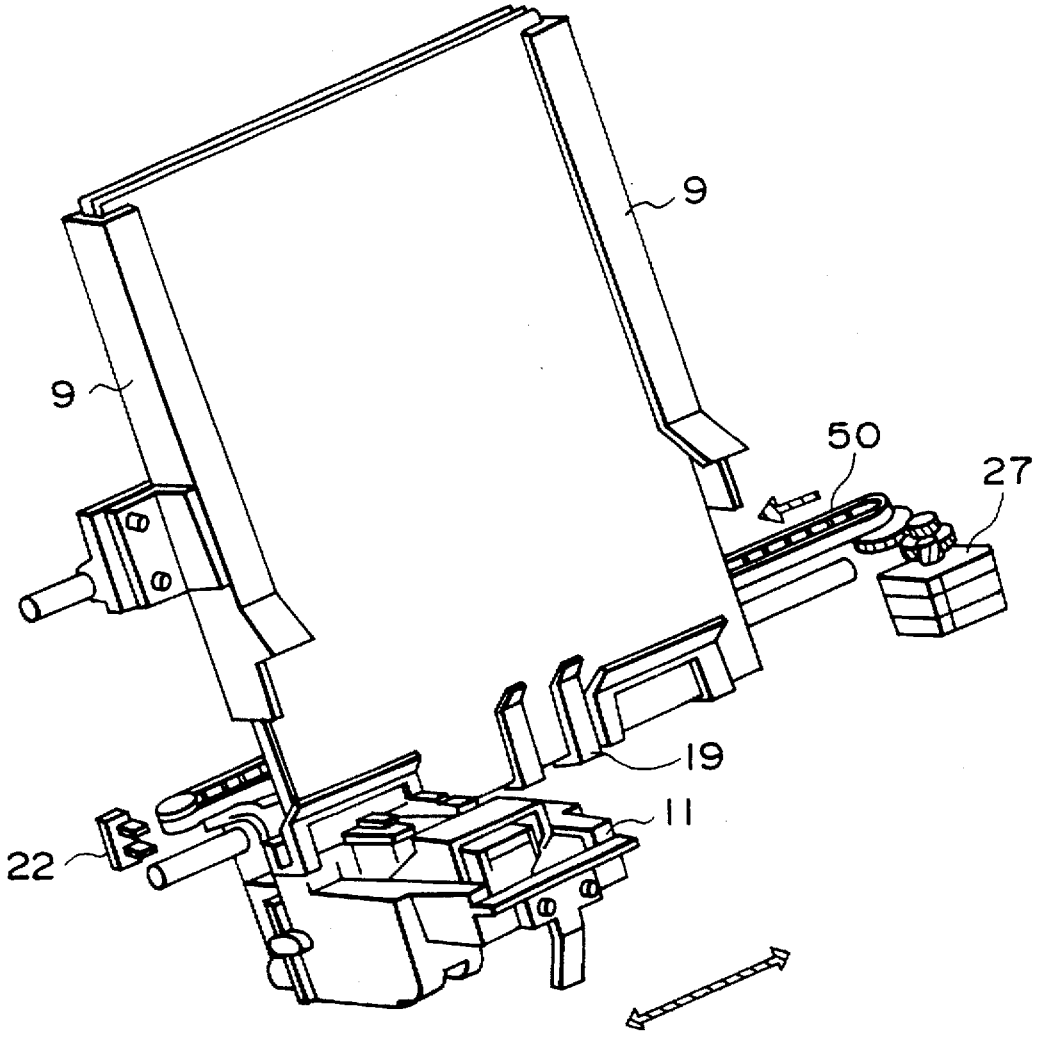
FIG. 4 is a perspective view showing a staple apparatus and its surrounding portions.

A rear-end fence 19 supports the rear edge of the recording paper at the lower side of the jogger fence 9, as shown in FIG. 3. The stapling apparatus 11 is driven via the staple belt 50 and is moved in the lateral direction by the stapler moving motor 27, as shown in FIG. 4. A stapler home sensor 22 defines a home position for the stapler.

The sensor 37 is disposed at such position that when it detects the rear edge of the recording paper, it immediately issues the command "ON" to the returning solenoid 30 to cause the returning roller 5 to operate and impinge upon the rear edge of the recording paper, thereby driving the paper.

Figure 5:
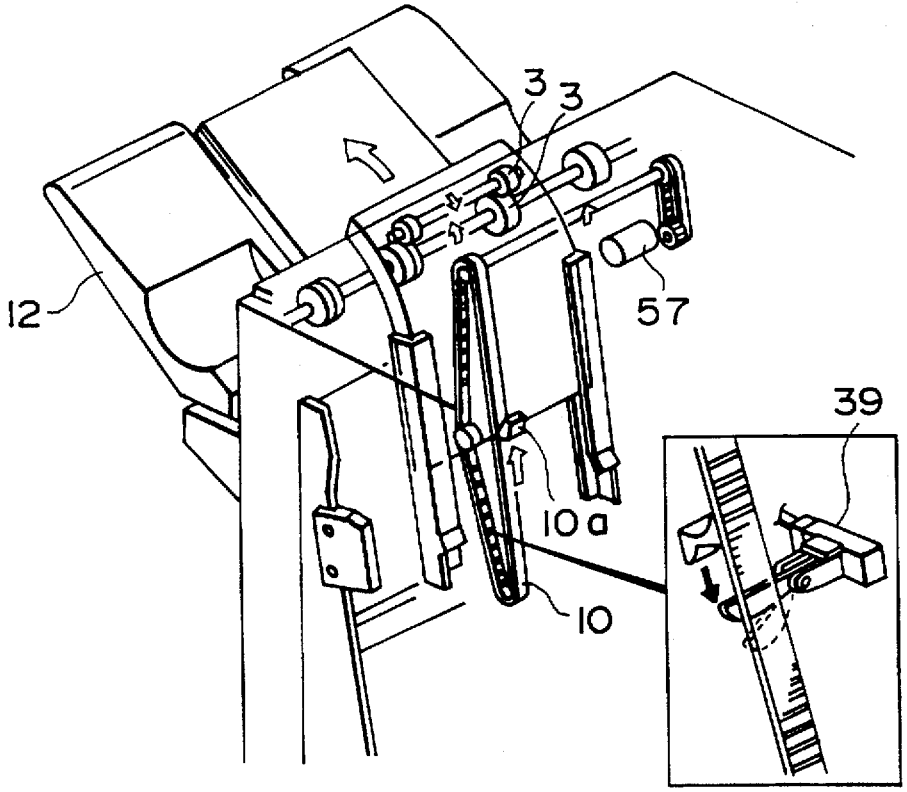
FIG. 5 is a partially transparent perspective view showing the state of discharging the bound recording paper bundle by use of the discharging belt.

As shown in FIG. 5, the rear edge of the recording paper bundle which has been bound by the stapling apparatus 11 is engaged with the discharging claw 10*a* mounted on the discharging belt 10, and the paper bundle is discharged into the paper discharging tray 12 by the rotation of the discharging belt 10.

The electric circuit system of the subsequent recording paper treatment apparatus relating to this embodiment is described hereinafter.

Figure 6:
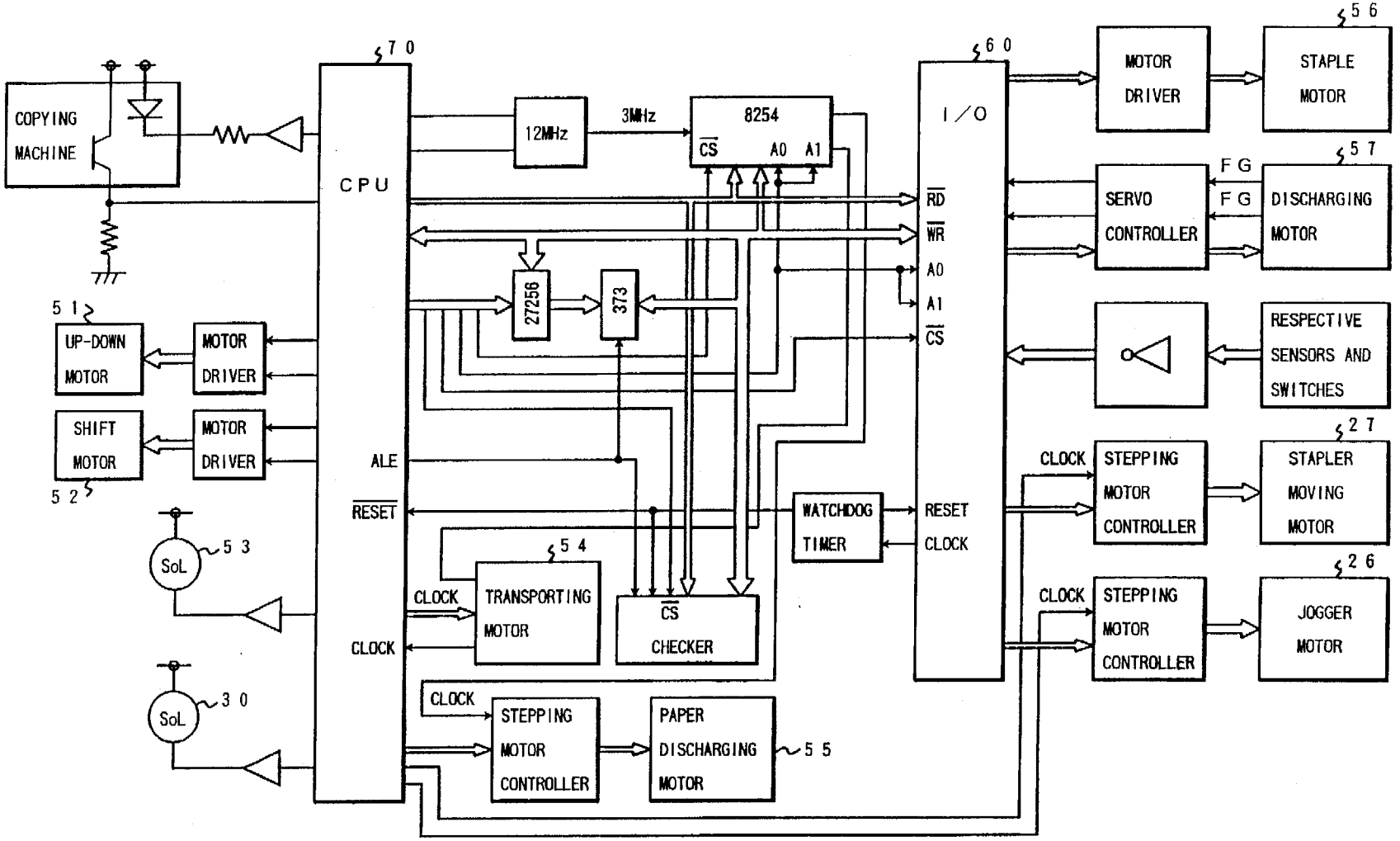
FIG. 6 is a block diagram showing the circuit of the subsequent recording paper treatment apparatus of the embodiment according to the present invention.

As shown in FIG. 6, the signals from the respective switches on the control panel (not shown in FIG. 6) of the apparatus main body and the respective sensors are inputted to the CPU 70 through the I/O interface 60. The CPU 70 drives, in accordance with the inputted signals, the up-and-down motor 51, the shift motor 52, a branch solenoid 53, the returning solenoid 30, the conveying motor 54, a paper discharging motor 55 which drives the discharging rollers 3, a stapling motor 56, a discharging motor 57 which drives the belt 10, the stapler moving motor 27, and the jogger motor 26. The pulse signals of the conveying motor 54 are inputted into the CPU 70 and counted thereby, and the returning solenoid 30 is controlled in accordance with the counted value.

Next, the operation in the case of selecting a non-staple mode is described hereinafter.

The copied recording paper is received by the inlet roller 1, conveyed by the upper conveying roller 2, and discharged by the discharging roller 3 onto the paper discharging tray 12. The alignment of the recording paper in the lateral direction is performed by the lateral push roller 7 and the aligned paper is stacked on the paper discharging tray 12.

The lateral push roller 7 is lowered when the discharged paper sensor 38 detects the rear edge of the recording paper, and thereby the stacking performance is improved. As the copied recording papers are discharged in order, the paper surface lever 13 rises up (pivots in a clockwise direction), which is detected by the paper surface sensor 33. The surface of the paper discharging tray 12 is lowered by driving the up-and-down motor 51, and thereby the level of the paper surface is always controlled to a correct height.

In the sort and stack modes, the paper discharging tray 12 is shifted laterally (right and left) by the shift motor 52 in accordance with the partition signal emitted from the control panel of the apparatus main body, etc. and the partitioning operation is performed until the end of the job. The paper discharging tray 12 is then lowered by approximately 30 mm in order to facilitate taking out the recording paper.

When the staple mode is instead selected, as shown in FIG. 2, the jogger fence 9 expands from a home position corresponding to the paper width to a waiting position spaced by 7 mm from the home position. The recording paper is conveyed by the lower conveying roller 4 driven by the conveying motor 54. When the rear end of the recording paper passes through the paper discharging sensor 37, the jogger fence 9 jogs (reciprocates) inward and back by 5 mm from the waiting position. The lateral position of the recording paper is thereby set.

The detection signal from the sensor 37 is inputted into CPU 70 which counts the transmission pulses from the conveying motor 54 starting at the time point of receiving the detection signal. After transmitting a predetermined number of pulses the CPU 70 causes the returning solenoid 30 to turn on. The returning roller 5 then pivots and engages the recording paper so as to drive it in a downward direction and be longitudinally aligned by the rear end fence 19. Each time the recording paper accommodated in the staple tray 21 passes through the inlet sensor 36 (or the paper discharging sensor 37), a signal is inputted into the CPU 70 and the number of recording papers is counted.

After a predetermined time elapses since the returning solenoid 30 is turned off, the jogger fence 9 is further moved inward by 2 mm back to the home position by the jogger motor 26 and stopped temporarily.

The alignment of the recording paper in the longitudinal direction is finished at this time. Thereafter, the jogger fence 9 returns to the waiting position and awaits the next recording paper. This operation continues until the last page. At the last page, the jogging fence returns to the home position and holds the paper bundle in preparation for the staple operation.

Thereafter, stapling is performed. If plural stapling positions are designated, after finishing stapling at one position, the staple moving motor 27 is driven, and thereby the stapling apparatus 11 is moved along the rear end of the recording paper to the other stapling positions.

When the binding treatment is finished, the discharging motor 57 is driven to drive the discharging belt 10. At this time, the paper discharging motor 55 is also driven and starts to rotate the discharging rollers 3 in order to receive the recording paper bundle lifted up by the discharging claw 10*a*. At this time, the jogger fence 9 is controlled in accordance with the paper size and the number of bound papers.

For instance, if the number of bound sheets is smaller than a predetermined number or the size of the bound sheets is smaller than a predetermined size, or in case the number of the bound sheets is smaller than the predetermined number and the size of the bound sheets is also smaller than the predetermined size, the recording paper bundle is pressed by the jogger fence 9 when the rear end of the recording paper bundle is hooked by the discharging claw 10*a* and the paper bundle is conveyed.

The jogger fence retracts by 2 mm after a predetermined number of pulses is issued by the discharging belt home sensor 39 and so releases the restraint of the recording paper by the jogger fence 9. The predetermined number of pulses is set based upon the position where the discharging claw 10*a* impinges on the rear end of the recording paper bundle and that where the claw emerges from the jogger fence 9.

Further, if the number of bound sheets is larger than a set number or the size of the bound sheets is larger than the set size, the jogger fence 9 is retracted by 2 mm before the claw 10*a* engages the paper bundle. In all cases, when the recording paper bundle emerges from the jogger fence 9, the jogger fence 9 expands by 5 mm to the waiting position in preparation for the next recording paper. It is possible to adjust the restraint force by suitably setting the distance between the jogger fence 9 and the recording paper.

The series of operations mentioned heretofore are repeated until the last job.

Next, the control operation at the time of the staple processing is explained, referring to FIGS. 7 through 19.

Figure 7:
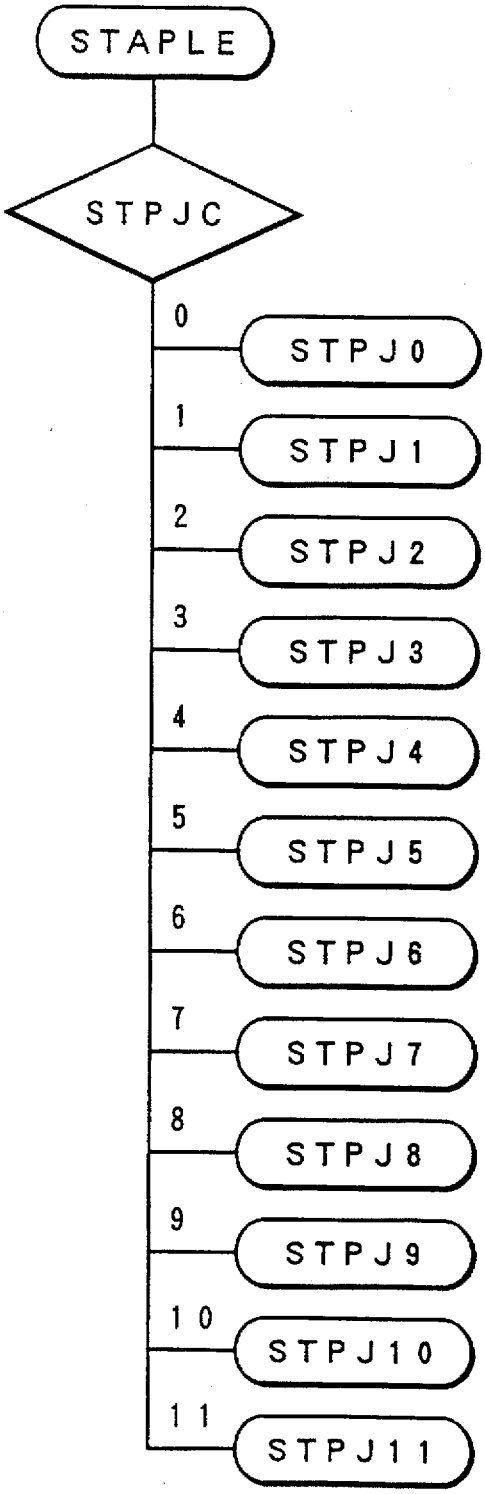
FIG. 7 is a flow chart showing a main routine at the time of performing the staple processing.

FIG. 7 is a flow chart of the main routine at the time of stapling and FIGS. 8 through 19 are flow charts of sub-routines at the time of stapling.

The flow chart of FIG. 7 shows the flow in which, when the recording paper conveyed onto the staple tray 21 is stacked on the staple tray 21, the paper end alignment is performed by the jogger fence 9, stapling is executed on the recording paper stacked on the staple tray 21 in accordance with the staple signal transmitted from the copying machine and the processed recording paper is discharged onto the paper discharging tray 12.

Moreover, when the stapling mode is selected before the main routine at the time of stapling shown in FIG. 7, the location of the jogger fence 9 is determined by the recording paper size signal. Then, as shown in FIG. 2, the jogger fence 9 is moved from the home position and caused to wait at the waiting position, for instance 7 mm from the side of the recording paper. The main routine at the time of stapling shown in FIG. 7 is carried out from the waiting position of the jogger fence 9.

STPJC is a JOB counter for performing paper end alignment, stapling and paper discharged after stapling. In accordance with the contents (data) of the STPJC, the procedure jumps up to any one of the sub-routines STPJ 0~STPJ 11. For instance, when STPJC=1, the sub-routine of STPJ 1 is processed.

Figure 8:
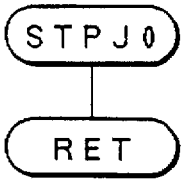
FIG. 8 is a flow chart showing a sub-routine at the time of performing the staple processing.

When STPJ 0 as shown in FIGS. 8 is zero "0", the procedure returns, i.e., goes back to the main routine.

Figure 9:
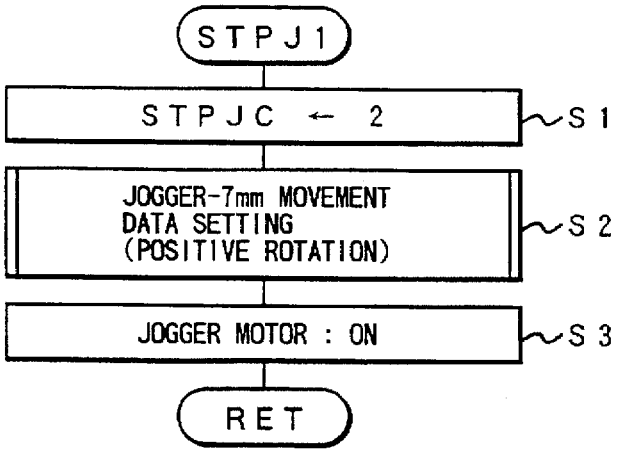
FIG. 9 is a flow chart showing another sub-routine at the time of performing the staple processing.

When the recording paper is conveyed and the paper discharging sensor 37 shown in FIG. 1 detects the passing of the recording paper's rear end, "1" is set as STPJC and the sub-routine of STPJ 1 shown in FIG. 9 is processed. In this sub-routine, "2" is set as STPJC (S1) and the jogger fence 9 is moved in order to perform paper alignment. At this time, a sub-routine (not shown) for performing the forward movement of the jogger fence 9 is called out (S2). In accordance with the forward movement data, the jogger fence 9 is moved (forwardly moved) toward the recording paper stacked on the staple tray 21 (S3) by turning on the jogger motor 26.

Figure 10:
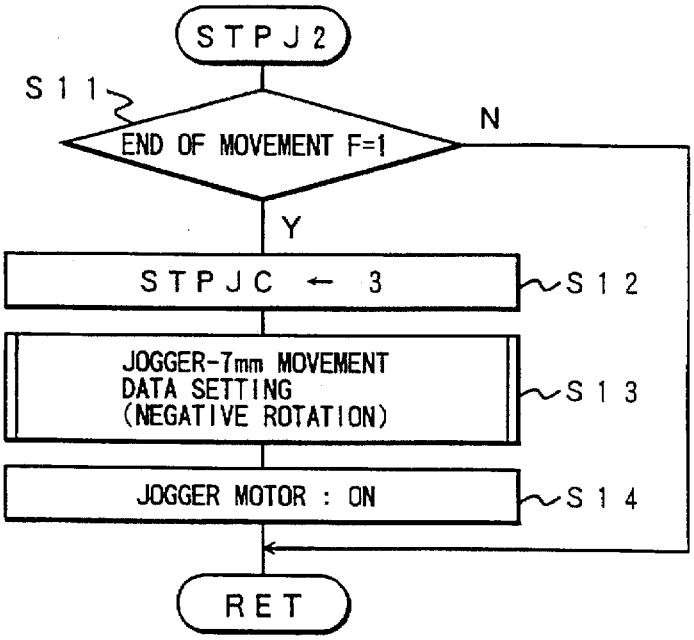
FIG. 10 is a flow chart showing still another sub-routine at the time of performing the staple processing.

Next, when "2" is set as STPJC at the sub-routine shown in FIG. 9, the sub-routine of STPJ 2 shown in FIG. 10 is processed. At this time, it is checked whether the termination of movement F (Flag) is set to "1" (S12). The termination of movement F is set to "1" when the jogger fence 9 completes its movement by the predetermined forward movement distance. In this situation, the control of the forward movement amount of the jogger fence 9 is performed by another sub-routine (not shown) as mentioned before. Moreover, the termination of movement F is set with the other sub-routine (not shown) which controls the forward movement amount of the jogger fence 9.

When the movement termination F is set to "1" (YES at S11, YES is represented by "Y" in FIG. 10), "3" is set as STPJC (S12), and the paper alignment is performed by moving the jogger fence 9. At this time, the sub-routine setting the data for performing backward movement of the jogger fence 9 is called out (S13), and the jogger fence 9 is retracted from the recording paper stacked on the staple tray 21 via the jogger motor 26 (S14). In the case of "NO" at S11, the procedure returns to the main routine.

Figure 11:
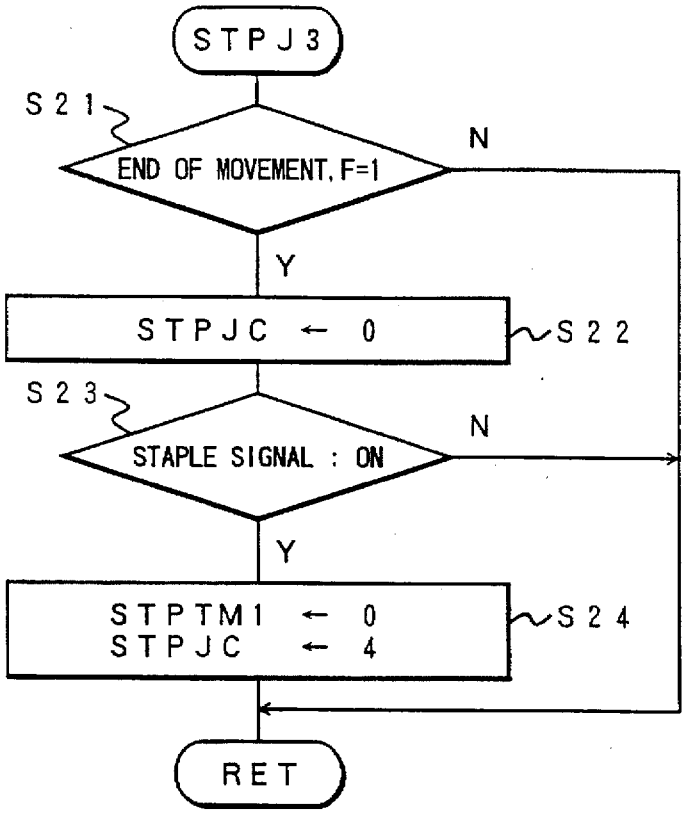
FIG. 11 is a flow chart showing still another sub-routine at the time of performing the staple processing.

Next, when "3" is set as STPJC at the sub-routine shown in FIG. 11, the sub-routine of STPJ3 shown in FIG. 11 is processed. At STPJ 3, it is checked whether the movement termination F (Flag) is set to "1" (S21). This movement termination F is set as "1" when the jogger fence 9 completes its movement by the predetermined backward movement distance.

When the movement termination F is set to "1" (YES at S21), "0" is set as STPJC (S22) and it is checked whether the staple signal is set as "1" at S23. The staple signal is transmitted from the copying machine.

When the staple signal is set as "1" (YES at S23), STPTM 1 is cleared (set to "1") and "4" is set as STPJC (S24). Here, STPTM 1 is a timer, and the count-up of STPTM 1 is performed by another sub-routine (not shown).

Until the jogger fence 9 returns to its waiting position and the staple signal is turned on, the afore-mentioned jogging operation is repeated ("NO" at S21, and "NO" at S23).

Figure 12:
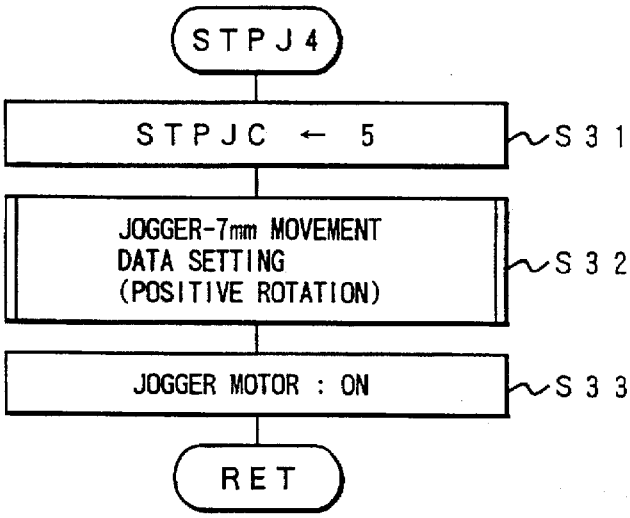
FIG. 12 is a flow chart showing still another sub-routine at the time of performing the staple processing.

Next, when "4" is set as STPJC at the sub-routine shown in FIG. 11, the sub-routine of STPJ 4 shown in FIG. 12 is processed. And further, "5" is set as JTPJC at STPJ4 (S31), and the alignment of the paper is performed by moving the jogger fence 9. At this time, the sub-routine for setting the data which forwardly moves the jogger fence 9 is called out (S32). Thereby, the jogger fence 9 performs the aforementioned forward movement via the jogger motor 26.

Figure 13:
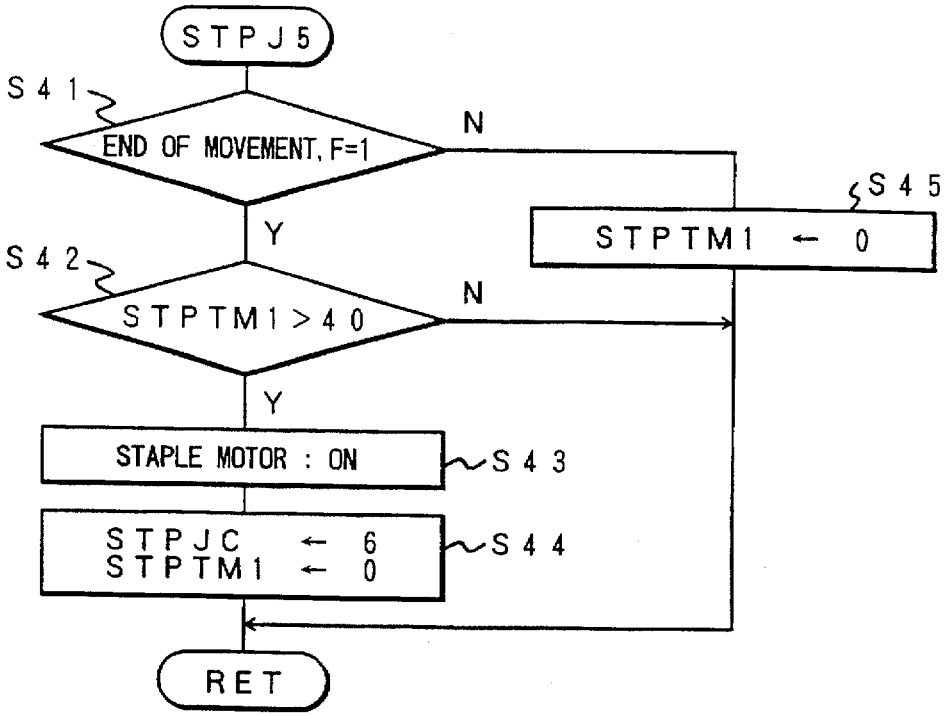
FIG. 13 is a flow chart showing still another sub-routine at the time of performing the staple processing.

Next, when "5" has been set as STPJC in the sub-routine shown in FIG. 12, the sub-routine of STPJ 5 shown in FIG. 13 is processed. At STPJ 5, it is checked whether the movement termination F (Flag) is set to "1" (S41). The movement termination F is set to "1" when the jogger fence 9 completes its movement by the designated predetermined forward distance.

When the movement termination F is set to "1" ("YES" at S41), it is checked whether STPTM 1 exceeds "40" (S42). When STPTM 1 exceeds "40" ("YES" at S42), the staple motor 56 is turned on (S43). The recording paper stacked on the staple tray 21 is stapled by turning on the staple motor 56. when STPTM 1 is not larger than "40" (does not exceed "40") ("NO" at S42), the procedure returns. The number "40" of STPTM 1 signifies a predetermined value which is a waiting time until the recording paper becomes stabilized, for instance, "40" corresponds to 200 ms. Further, "6" is set as STPJC and STPTM 1 is cleared to "0" (S44).

When the movement termination F of the jogger fence 9 has not yet been set ("NO" at S41), STPTM 1 is in a state of being cleared to "0" (S45). And then, the procedure returns to the main routine.

Figure 14:
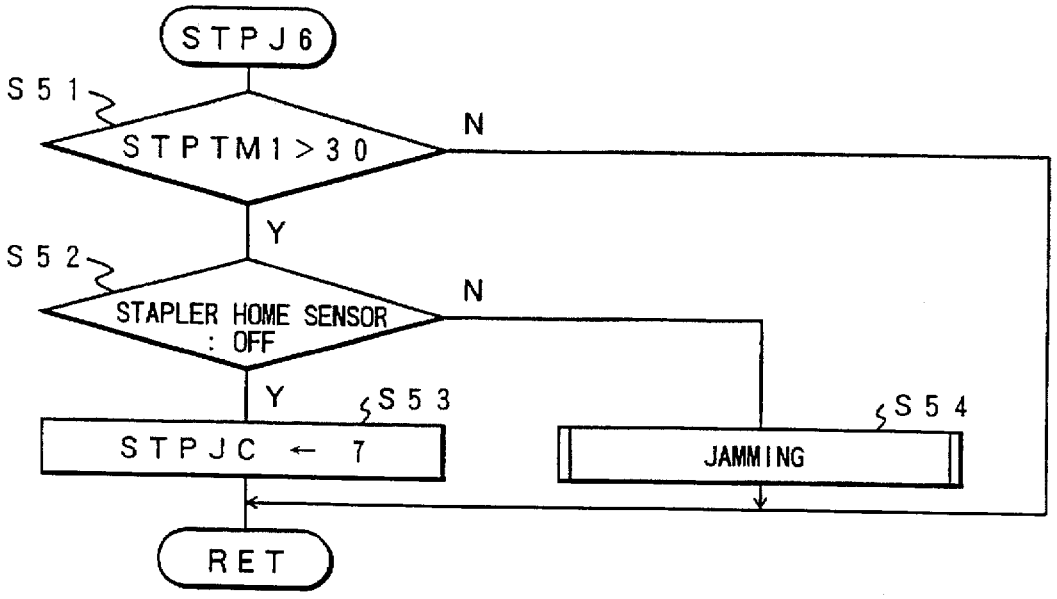
FIG. 14 is a flow chart showing still another sub-routine at the time of performing the staple processing.

Next, when "6" is set as STPJC at the sub-routine shown in FIG. 13, the sub-routine of STPJ 6 shown in FIG. 14 is processed. At STPJ 6, it is checked whether STPTM 1 exceeds "30" (S51). When STPTM 1 exceeds "30" ("YES" at S51), it is checked whether the stapler home sensor 22 is turned off (S52). The stapler home sensor 22 includes a rotation plate which rotates in synchronism with the stapling operation and has a slit for detecting its home position, The slit is detected by the stapler home sensor 22. The stapler operates when the stapler home sensor 22 is opposed to the slit of the rotation plate.

Consequently, when the stapler driven in accordance with the sub-routine shown in FIG. 13 operates normally, the stapler home sensor 22 deviates from the home position (slit), and thereby the state of the stapler home sensor 22 changes from "ON" to "OFF." When the sensor 22 returns to the home position (slit), its state becomes "ON" again. When the stapler home sensor 22 is turned off ("YES" at S52), namely when the stapler operates normally, "7" is set as STPJC (S53).

When STPTM 2 is not larger than "30" ("NO" at S51), the procedure returns.

When the staple home sensor 22 is not turned off ("NO" at S52), the sub-routine of transmitting a staple abnormal signal to the copying machine is executed (S54) and the procedure returns.

Figure 15:
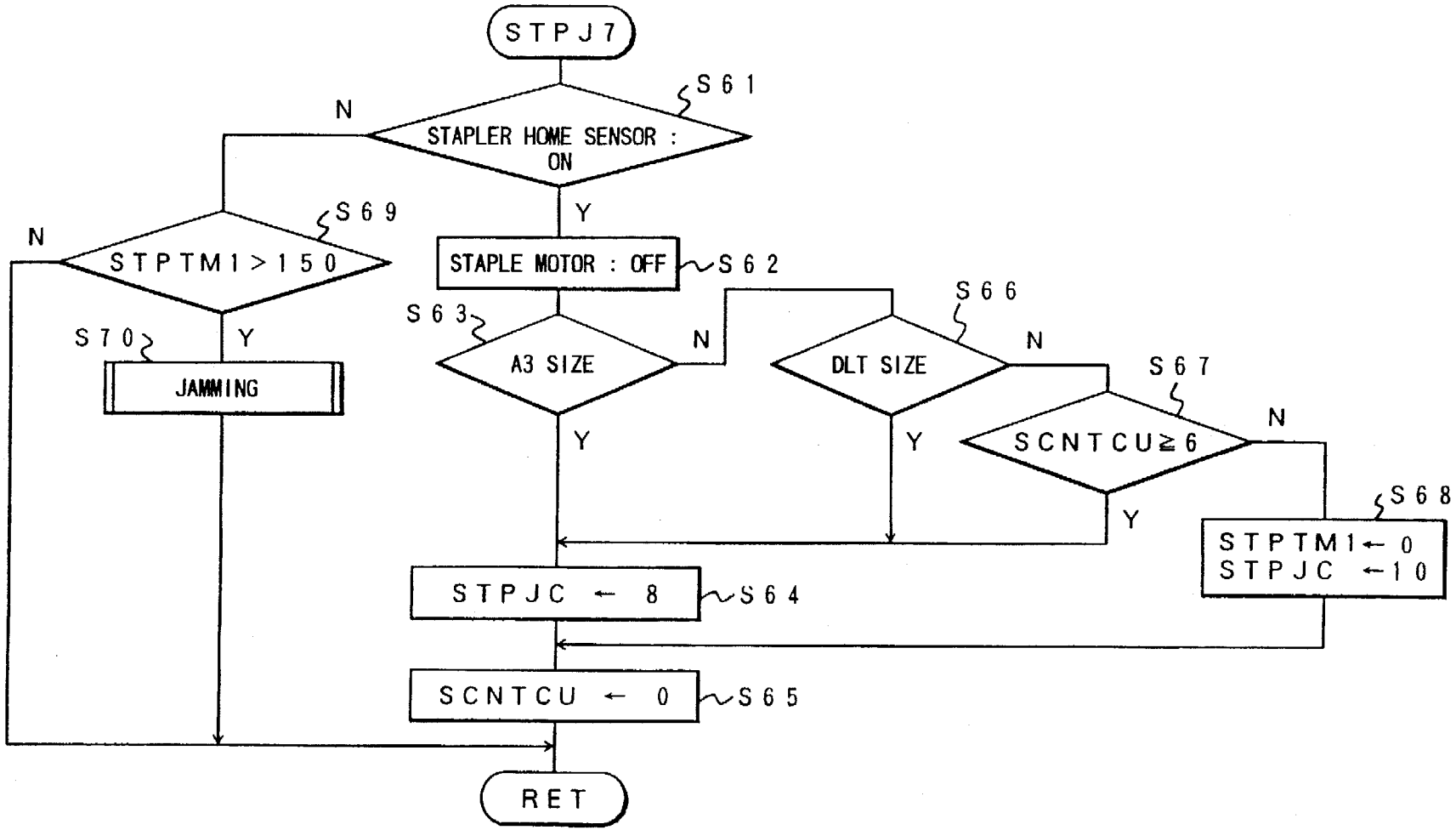
FIG. 15 is a flow chart showing still another sub-routine at the time of performing the staple processing.

Next, when "7" is set as STPJC at the sub-routine shown in FIG. 14, the sub-routine of STPJ 7 shown in FIG. 15 is processed. At STPJ 7, it is checked whether the stapler home sensor 22 is turned on (S61).

When the stapler home sensor 22 is turned on ("YES" at S61), the staple motor 56 is turned off (S62), and it is checked whether the recording paper discharged from the copying machine is of A-3 size (S63).

When the recording paper is of A-3 size ("YES" at S63), "8" is set as STPJC (S64), and "0" is set as SCNTCU and thereby SCNTCU is cleared (S65). This SCNTCU is a counter which counts the number of the recording papers stacked on the staple tray 21.

When the paper is not A-3 size ("NO" at S63), it is checked whether the paper is DLT (Double Letter) size (S66). When the paper is DLT size ("YES" at S66), the procedure advances to S64. When the paper is not DLT size ("NO" at S65), it is checked whether SCNTCU exceeds "6" (S67). When the number of the stacked recording papers exceeds the predetermined number (SCNTCU is set to "6") ("YES" at S67), the procedure advances to S64.

The number is "6" is a predetermined number, and it is checked whether the number of the recording papers stacked on the staple tray 21 exceeds the predetermined value. When the number of the stacked recording papers is smaller than the predetermined value ("NO" at S67), STPTM 1 is reset and "10" is set as STPJC (168). At this time, the procedure advances to S65.

When the stapler home sensor 22 is not turned on ("NO" at S61) and STPTM 1 exceeds "150" ("YES" at S69), the sub-routine of transmitting to the copying machine the staple abnormal signal showing that the stapling operation has not yet terminated normally is executed (S70). When STPTM 1 is not larger than "150" ("NO" at S69), the procedure returns. The number "150" is a predetermined value.

The size of the recording paper and the number of the recording papers stacked on the staple tray 21 are checked in accordance with the above sub-routine.

In the above embodiment, although the paper sizes A-3 and DLT are described, other sizes can be checked. Furthermore, although the number of the recording papers stacked on the staple tray 21 is controlled, for instance 6 in the illustrated embodiment, this number can be changed.

Figure 16:
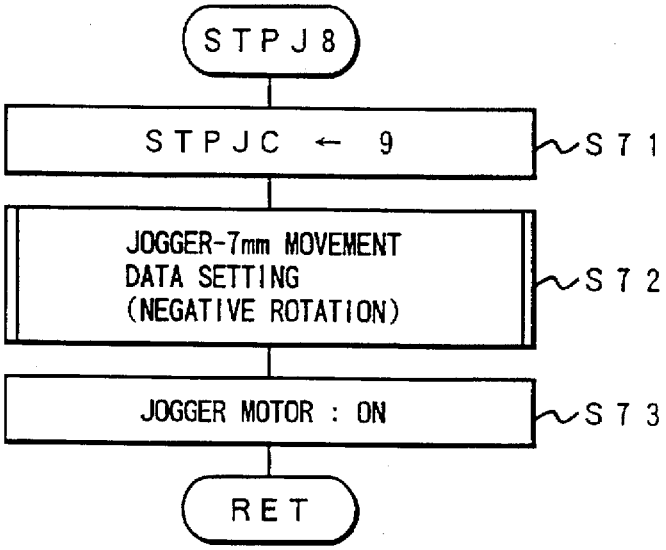
FIG. 16 is a flow chart showing still another sub-routine at the time of performing the staple processing.

When "8" is set as STPJC at the sub-routine shown in FIG. 15, the sub-routine of STPJ 8 shown in FIG. 16 and further the sub-routine of STPJ 9 are processed, and thereby the bundle of the recording paper is sent out by the discharging claw 10*a* of the discharging belt 10 without being restricted by the jogger fence 9.

At STPJ 8, "9" is set as STPJC (S71). The paper alignment is performed by moving the jogger fence 9. At this time, the sub-routine of setting data for backwardly moving the jogger fence 9 is called out (S72). The jogger fence 9 is moved in the direction of the backward movement by the jogger motor 26 (S73) and thereby the jogger fence performs backward movement and returns to its waiting position after finishing the stapling operation.

Figure 17:
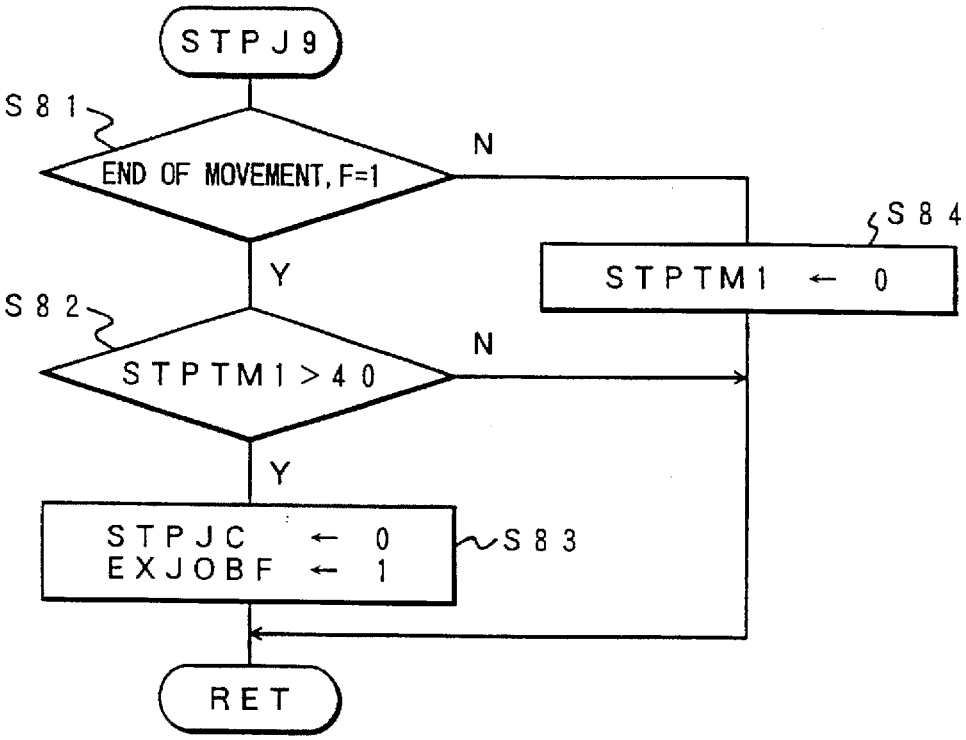
FIG. 17 is a flow chart showing still another sub-routine at the time of performing the staple processing.

Next, the sub-routine of STPJ 9 shown in FIG. 17 is processed. At STPJ 9, it is checked whether the movement termination F (Flag) is set to "1" (S81). This movement termination F is set "1" when the jogger fence 9 completes its movement by the designated predetermined backward distance. When the movement termination F is set to "1" ("YES" at S81), it is checked whether STPTM 1 exceeds "40" (S82). When STPTM 1 exceeds "40" ("YES" at S82), the procedure advances to S83. On the contrary, when STPTM 1 does not exceed "40" ("NO" at S82), the procedure returns.

At S83, "0" is set as STPJC and the flag of EXJOBF is set to "1". By setting the flag to "1", the stapled recording paper is discharged onto the paper-discharging tray 12 in accordance with another (not-shown) sub-routine.

When the movement termination F is not the set to "1" ("NO" at S81), STPTM 1 is cleared to "0" (S84), and the procedure returns.

Figure 18:
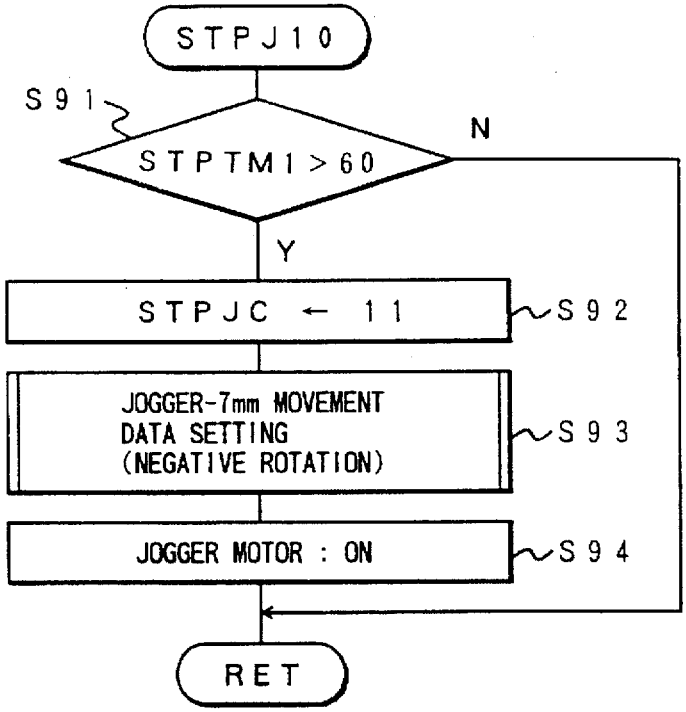
FIG. 18 is a flow chart showing still another sub-routine at the time of performing the staple processing.
Figure 19:
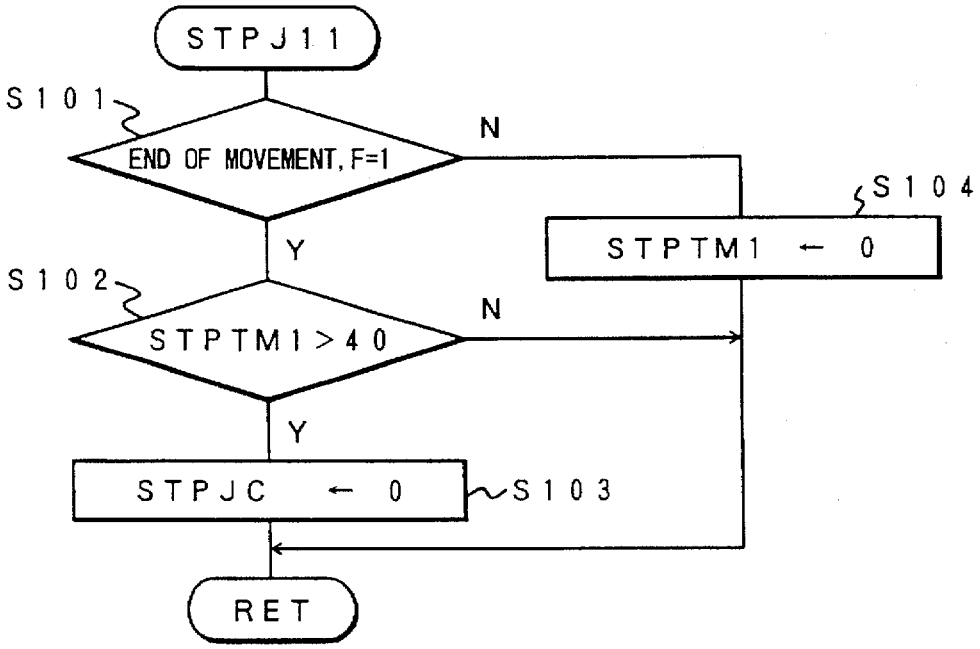
FIG. 19 is a flow chart showing still another sub-routine at the time of performing the staple processing.

In case that "10" is set as STPJC in accordance with the sub-routine of STPJ 7 shown in FIG. 15, the sub-routine of STPJ 10 shown in FIG. 18 and the sub-routine of STPJ 11 shown in FIG. 19 are respectively processed. In accordance with the above sub-routines, at the time of moving the bundle of the recording papers by use of the discharging belt, the jogger fence 9 is moved to the recording paper bundle pressing position, and the recording paper bundle is moved by the discharging belt while being pressed. In STPJ 10, it is checked whether the cleared STPTM 1 exceeds "60" at S68 (S91). When STPTM 1 exceeds "60" ("YES" at S91), "11" is set as STPJC (S92).

The jogger fence 9 presses both ends surfaces of the recording paper bundle from the moment immediately before the claw of the belt impinges on the stacked recording paper bundle.

The step S92 is for performing backward movement of the jogger fence 9 when a predetermined time period elapses from the impingement of the claw on the paper bundle. The predetermined time period is that of releasing the restraint of the recording paper bundle pressed by the jogger fence 9 at a position before the discharging rollers. The recording paper bundle can thus be smoothly discharged without suffering unnecessary transporting resistance at the time of its discharge by the discharging roller.

In sub-routine of setting the data for performing the backward movement of the jogger fence 9, at the position where the leading end of the recording paper is located just upstream of the discharging roller (S91), after setting the movement data of the jogger fence 9 at S93, the jogger fence 9 moves to its waiting position, and thereby the restraint of the recording paper bundle by the jogger fence 9 is released.

Next, at the time of processing the sub-routine of STPJ 11 shown in FIG. 19, it is checked whether the movement termination F (Flag) is the setting "1" (S101). The movement termination F is set to "1" when the jogger fence 9 completes its movement by the designated predetermined moving distance. Namely, when the jogger fence 9 moves to the waiting position and the movement termination F is set to "1" ("YES" at S101), it is checked whether STPTM 1 exceeds "40" (S102). When STPTM 1 exceeds "40" ("YES" at S102), "0" is set as STPJC (S103). When STPTM 1 does not exceed "40" ("NO" at S102), the procedure returns.

When the jogger fence 9 does not arrive at the waiting position ("NO" at S101), STPTM 1 is cleared (set to "0") (S104), and the procedure returns.

The afore-mentioned embodiment thus comprises a jogger fence 9 for laterally aligning the recording paper having an image formed thereon, a rear edge fence 19 for alignment in the longitudinal direction, a stapling apparatus 11 for binding the matched recording paper bundle, and a discharging belt 10 having a claw for moving the bound recording paper bundle onto the paper discharging tray.

When the recording paper bundle is moved by the discharging belt 10, the jogger fence 9 presses the recording paper bundle, which is then moved by the discharging belt 10. Consequently, a conveying resistance is temporarily applied thereto, and it is possible to prevent bounding of the recording paper bundle at the time of impingement of the claw 10*a* thereon. Therefore, the recording paper bundle can be stably conveyed. Furthermore, it is not necessary to greatly lower the speed at the time of the impingement, and thereby productivity can be greatly improved.

In the case of moving the recording paper bundle by use of the discharging belt 10, when the paper number or size is not larger than the predetermined number or size, since the jogger fence 9 is moved to the recording paper bundle pressing position, bounding of the recording paper bundle can be prevented and thereby the paper bundle can be stably conveyed. However, a large paper number or size recording paper bundle having an inherently large conveying resistance is not pressed by the jogger fence.

Furthermore, in the afore-mentioned embodiment, after moving the recording paper bundle pressed by the jogger fence 9 by a predetermined distance by use of the discharging belt 10, the pressing of the recording paper bundle is released. Consequently, only at the moment of or immediately after the impingement of the claw 10*a* upon the recording paper rear edge is the conveying resistance temporarily increased, and thereby the recording paper bundle can be conveyed stably.

Furthermore, in the afore-mentioned embodiment, the restraint of the recording paper by the jogger fence 9 is released at a position before the discharging roller. Therefore, the conveying resistance can be applied temporarily during the time period from the moment of the impingement between the claw 10*a* and the rear end of the recording paper bundle to another moment immediately before discharging the recording paper bundle by the discharging roller.

Consequently, when the recording paper bundle is discharged by the discharging roller, the conveying resistance can be eliminated, and thereby it is possible to realize stable paper conveying.

What is claimed as new and desired to be secured by Letters Patent of the United States is:

1. A subsequent paper treatment apparatus for paper sheets discharged from a paper forming apparatus, comprising:

a discharged paper tray for receiving the paper sheets;

a discharging belt provided with a claw for moving said bound recording paper bundle toward said discharged paper tray;

a jogger fence for aligning the paper sheets in a direction lateral to the direction of movement toward said discharged paper tray;

a rear-edge fence for determining a standard position of the paper sheets in said direction of movement;

a stapling apparatus for binding a bundle of the aligned paper sheets in the standard position; and means for pressing at least one of said bound recording paper bundles with said jogger fence in order to increase conveying resistance of said at least one of said bound recording paper bundles when at least one of said recording paper bundles is moved by said discharging belt.

2. A subsequent paper treatment apparatus as defined in claim 1 wherein said means for pressing comprises means for pressing said bundles having paper sheet sizes which are not larger than a predetermined value.

3. A subsequent paper treatment apparatus as defined in claim 1 wherein said means for pressing comprises means for pressing said bundles having a number of paper sheets which is not larger than a predetermined value.

4. A subsequent paper treatment apparatus as defined in claim 1, wherein said means for pressing at least one of said bound recording paper bundles with said jogger fence comprises means for pressing at least one of said bound recording paper bundles with said jogger fence for a predetermined distance of movement of said bundle.

5. A subsequent paper treatment apparatus as defined in claim 1, wherein the pressing of said recording paper bundle by said jogger fence is released at a position upstream of a discharging roller for discharging said recording paper bundle onto said discharged paper tray.

6. A subsequent paper treatment apparatus for paper sheets discharged from a paper forming apparatus, comprising:

a discharged paper tray for receiving the paper sheets;

a discharging belt provided with a claw for moving said bound recording paper bundle toward said discharged paper tray;

a rear-edge fence for determining a standard position of the paper sheets in a direction of movement;

a stapling apparatus for binding a bundle of the paper sheets in the standard position; and means for pressing ones of said bound recording paper bundles which are susceptible to bounding when engaged by said claw so as to increase conveying resistance of said ones of said bound recording paper bundles when said ones of said recording paper bundles are moved by said discharging belt.

7. A method of subsequent paper treatment for paper sheets discharged from a paper forming apparatus, comprising the steps of:

using a jogger fence for aligning the paper sheets in a direction lateral to a direction of movement toward a discharged paper tray;

using a rear-edge fence for determining a standard position of the paper sheets in said direction of movement;

binding a bundle of the aligned paper sheets in the standard position;

using a discharging belt provided with a claw for moving said bound recording paper bundle toward said discharged paper tray; and pressing at least one of said bound recording paper bundles with said jogger fence in order to increase conveying resistance of said at least one of said bound recording paper bundles when at least one of said recording paper bundles is moved by said discharging belt.

* * * * *